US007410054B2

(12) United States Patent
Shatford et al.

(10) Patent No.: US 7,410,054 B2
(45) Date of Patent: Aug. 12, 2008

(54) LIGHT BULB DISPOSAL TUBE

(75) Inventors: Will Shatford, La Canada, CA (US); Robert L. Czubiak, Woodland Hills, CA (US)

(73) Assignee: MDS, Inc., Tustin, CA (US)

( * ) Notice: Subject to any disclaimer, the term of this patent is extended or adjusted under 35 U.S.C. 154(b) by 153 days.

(21) Appl. No.: 10/808,966

(22) Filed: Mar. 25, 2004

(65) Prior Publication Data

US 2004/0188298 A1 Sep. 30, 2004

Related U.S. Application Data

(60) Provisional application No. 60/458,112, filed on Mar. 26, 2003.

(51) Int. Cl.
*B65D 85/42* (2006.01)

(52) U.S. Cl. ..... 206/418; 206/0.7; 206/484; 383/109

(58) Field of Classification Search ..... 206/418 T, 206/204, 0.7, 484.2, 484; 383/109, 904, 383/907

See application file for complete search history.

(56) References Cited

U.S. PATENT DOCUMENTS

| | | | | | |
|---|---|---|---|---|---|
| 3,623,672 | A | * | 11/1971 | De Frank | 241/36 |
| 4,662,535 | A | * | 5/1987 | Loveland | 220/367.1 |
| 4,880,114 | A | * | 11/1989 | Korte | 206/418 |
| 5,048,692 | A | * | 9/1991 | Handler et al. | 383/203 |
| 5,069,694 | A | * | 12/1991 | Cullen et al. | 96/154 |
| 5,515,971 | A | * | 5/1996 | Segrest | 206/418 |
| 5,542,535 | A | * | 8/1996 | Dalton | 206/419 |
| 5,553,708 | A | * | 9/1996 | Lawrence et al. | 206/419 |
| 6,315,448 | B1 | * | 11/2001 | Thrall | 383/205 |

* cited by examiner

*Primary Examiner*—David T Fidei

(57) ABSTRACT

Provided is a system, apparatus and methods of use for the safe and easy handling and disposing of light bulbs. The system provides a disposal tube comprising one or more layers of puncture resistant material and a means for absorbing metals or gasses that may be released when the light bulb is broken, such as by externally striking the disposal tube and the bulb contained therein. The invention also provides a method for using the disposal tube as a means to safely handle and store the light bulbs.

5 Claims, 1 Drawing Sheet

LIGHT BULB DISPOSAL TUBE

CROSS REFERENCE TO RELATED APPLICATIONS

This application claims priority to Provisional Patent Application No. 60/458,112, filed Mar. 26, 2003, which is herein incorporated by reference in its entirety.

FIELD OF THE INVENTION

The present invention is generally related to the handling of light bulbs. More specifically, the present invention is related to transporting, storage and disposal of light bulbs.

BACKGROUND

Light bulbs, such as fluorescent incandescent, halogen, etc., are utilized throughout the world as a means of illuminating an area. Unfortunately, light bulbs do not last forever, creating a need to dispose of the used light bulb and replacing it with a new one. Since light bulbs are generally filled with a gas or harmful metals, disposal of light bulbs can be dangerous and/or environmentally unsafe, if done without care. Shattering a light bulb is unsafe due to flying broken glass and, depending upon the type of light bulb being discarded, it may also potentially be unhealthy due to the exposure to the gas or heavy metal inside the light bulb.

Accordingly, there has existed a need to provide a safe and easy means for light bulb disposal.

SUMMARY OF THE INVENTION

The present invention provides apparatus, methods and articles of manufacture for the handling and disposal of glass light bulbs. An object of the present invention is to provide a system for disposing of light bulbs comprising a disposal tube having an open end. In a preferred embodiment the disposal tube is made of puncture resistant material, such as, a heavy plastic. Also in a preferred embodiment the disposal tube further comprises a paper liner for added protection.

Another object of the present invention provides means within the disposal tube for absorbing metals or gasses that may be released when the light bulb is broken, such as, a strip of sulfur-impregnated carbon paper, a desiccant package of sulfur-impregnated activated carbon granules, or a strip of sulfur chalk.

Yet another object of the present invention is to provide a method of handling and disposing of glass light bulbs comprising: providing a disposal tube having an open end and further comprising a paper liner with a strip of sulfur-impregnated activated carbon paper, a desiccant package containing sulfur-impregnated activated carbon granules or a strip of sulfur chalk; inserting the bulb into the disposal tube; closing and sealing the open end of the disposal tube; striking the sealed disposal tube with a blunt force object; and disposing the glass from the bulb.

It is another object of the present invention to provide a method of transporting light bulbs comprising: providing a disposal tube, inserting the light bulb into the disposal tube; sealing the disposal tube for safe transit; and transporting the light bulb in the disposal tube. The tube provides for secure collection of the glass and gasses if the bulb is broken during transit and can also be used for the disposal of the light bulb when the bulb is no longer useable.

Additional objects, advantages and novel features of the invention will be set forth in part in the description and figures which follow, all of which are intended to be for illustrative purposes only, and not intended in any way to limit the invention, and in part will become apparent to those skilled in the art on examination of the following, or may be learned by practice of the invention.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown.

DETAILED DESCRIPTION OF PREFERRED EMBODIMENTS

Reference is now made to the accompanying Figures for the purpose of describing, in detail, preferred embodiments of the present invention. Like elements have the same numbers throughout the several views. The detailed description accompanying each Figure is not intended to limit the scope of the claims appended hereto.

Figure 1:
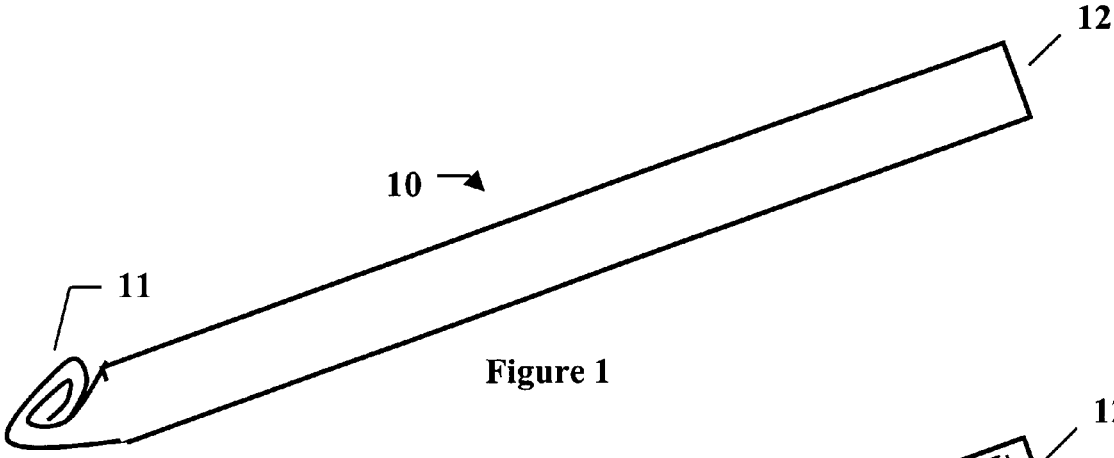
FIG. 1 is an illustration of an exemplary disposal tube in accordance with a preferred embodiment of the present invention for long fluorescent tubes.

An embodiment of the present invention comprises a disposal tube 10 for placing a light bulb to be disposed of therein. FIG. 1 is an exemplary illustration of disposal tube 10 in accordance with a preferred embodiment of the present system for disposing of or handling one or more light bulbs. For purposes of this disclosure, a fluorescent light bulb will be used for exemplary purposes and should not be considered to limit the application of the present invention. The light bulbs suitable for disposal by the disposal bag of the present invention preferably comprise globes of glass or other breakable materials.

In addition to the depicted fluorescent bulb, other types of light bulbs including, but are not necessarily limited to, halogen, incandescent, high intensity discharge, etc., may also utilize disposal tube 10. Accordingly, disposal tube 10 may be sized from less than three inches in length to more than three feet in length to accommodate the available variety of light bulbs, ranging from standard residential light bulbs to light bulbs used in vehicles or large commercial applications.

Disposal tube 10 may be made of any type of puncture resistant material, including paper, plastic, rubber, and the like, or combinations thereof. In accordance with a preferred embodiment, it is preferable that disposal tube 10 be made of a paper liner 20 within light mil puncture resistant plastic, such as 2 mil plastic. Thus, in the preferred embodiment, the selected puncture resistance plastic and the selected paper liner 20, together or each alone, is of sufficient thickness not to be pierced by shards of broken glass. At the same time, the material of disposal tube 10 is sufficiently flexible to allow the insertion of one or more light bulbs, and to allow the inserted light bulbs to be shattered by a means external to disposal tube 10. A one-size fits all disposal tube 10 is preferably used and adjusted for the particular bulb as described below. The length and diameter of disposal tube 10 may alternatively be dependent upon the length and diameter of the light bulb being disposed.

Figure 2:
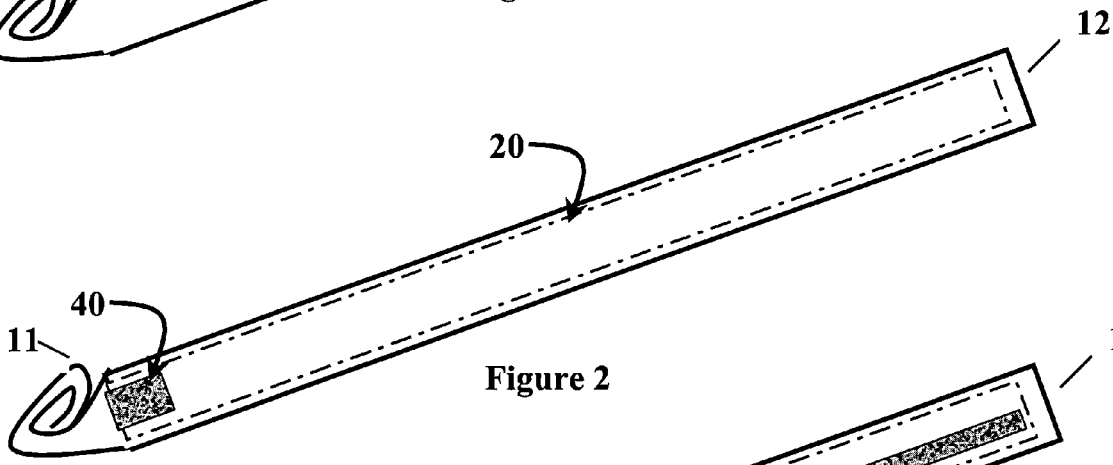
FIG. 2 is an illustration of an exemplary disposal tube in accordance with an alternative embodiment of the present invention with heavy paper liner and a desiccant package containing sulfur-impregnated activated carbon.

In a preferred embodiment, disposal tube 10 comprises heavy paper or a heavy paper liner 20 (as shown in FIG. 2) to help absorb the impact during bulb breakage and improve the puncture resistance of the disposal tube.

Figure 3:
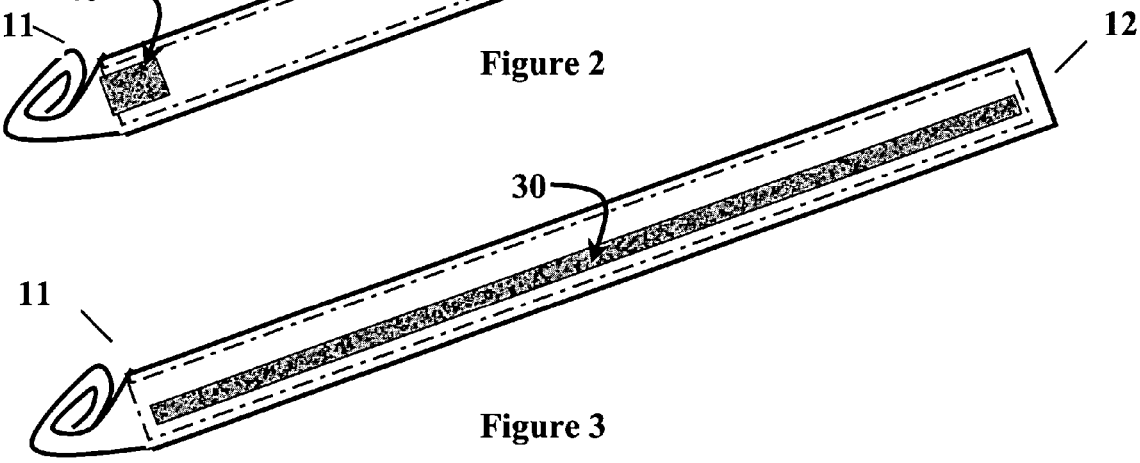
FIG. 3 is an illustration of an exemplary disposal tube in accordance with an alternative embodiment of the present invention with heavy paper liner and a strip of sulfur-impregnated activated carbon paper.
Figure 4:
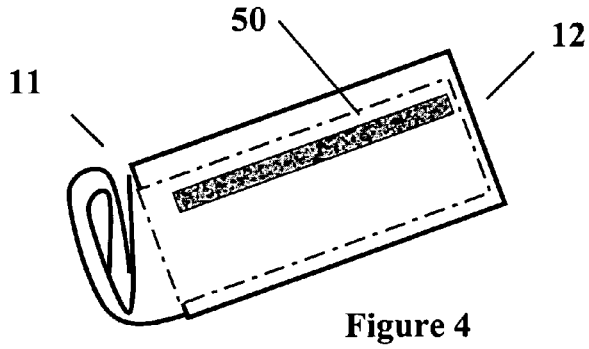
FIG. 4 is an illustration of an exemplary disposal tube in accordance with an alternative embodiment of the present invention with heavy paper liner and a strip of sulfur-impregnated activated carbon paper for a compact fluorescent lamp.

In an alternative embodiment, paper liner 20 incorporates a strip of sulfur-impregnated activated carbon paper 30 (as shown in FIG. 3). In another alternative embodiment, a desiccant package 40 containing sulfur-impregnated activated carbon granules (as shown in FIG. 2) is placed inside tube 10. In yet another embodiment, a strip of sulfur chalk 50 (as shown in FIG. 4) is applied to the inside of paper liner 20. Alternatively, sulfur is contained within paper liner 20. The strip of sulfur-impregnated activated carbon paper 30, desiccant package containing sulfur impregnated activated carbon granules 40, or sulfur chalk strip 50 allow disposal tube 10 to absorb the mercury included in the fluorescent bulb. In alternative embodiments, one skilled in the art would know of other chemicals that would be suitable and may be used for absorbing the mercury or absorbing other metal or gases that may be used in other light bulbs, or released when the bulbs are broken.

Disposal tube 10 is formed such that it is cylindrical in shape, having two ends. One end is open 11 and the opposing end 12 is closed (as shown in FIG. 1). Disposal tube 10 may be formed as a seamless bag or sleeve with one open end and one closed end. Alternatively, disposal tube 10 may be produced from one or more sheets of material formed into the cylindrical shape of a bag or sleeve. Closed end 12 prevents the light bulb from passing through disposal tube 10. Open end 11 of disposal tube 10 is open to permit insertion of the fluorescent bulb, or any bulb to be transported, stored or discarded. Once the bulb has been inserted into tube 10, open end 11 may be closed and sealed using any means of sealing such an opening, such that no pieces of glass are able to escape from tube 10 when the bulb is shattered. Such closure means include, but are not limited to, twist tie, clasp, clip, clamp, staple, Velcro, drawstrings, tape, pre-applied adhesive strip, pre-applied adhesive strip with a removable protective strip, fold over tabs, and the like. The sides of open end 11 may simply be drawn together or joined in the closure process, or open end 11 of the bag may be folded over one or more time before the closure means is applied, thereby sealing the bag.

The preferred method for disposing of a fluorescent bulb using disposal tube 10 in accordance with a preferred embodiment is set forth below. A user slides the fluorescent bulb fully into disposal tube 10 (Step 100). Open end 11 of disposal tube 10 is then sealed, preferably close to the end of the bulb (Step 101). Disposal tube 10 is then preferably placed on the ground and struck with a hammer, mallet or similar blunt force object without danger of injury from broken glass (Step 102*a*). Alternatively, disposal tube 10 may be dropped from a low height onto a hard surface, such as a garage floor or driveway, to avoid danger of injury from broken glass (Step 102*b*). The broken glass inside disposal tube 10 is then discarded (Step 103). Disposal tube 10 may be hit in other places to break the bulb into smaller pieces before disposing of disposal tube 10. In a preferred embodiment, disposal tube 10 is disposed of along with the glass. Therefore, each disposal tube 10 is utilized for a single bulb.

In an alternative embodiment, disposal tube 10 is reusable, wherein open end 11 is simply closed, but not sealed, after the bulb is inserted, and the broken glass is disposed of in a trash can and disposal tube 10 is reusable for the disposal of other bulbs. In yet another embodiment, disposal tube 10 is used to shatter and dispose of multiple bulbs at one time.

In still another embodiment, disposal tube 10 is used as packaging material, particularly for the sale or distribution of a new fluorescent bulb, although it may also be applied for handling by the user, such as in the home, office or institution. In this way, shopping for and transporting the new bulb is made safer for the customer in the event that the bulb is broken before the customer is able to install it at home or wherever the bulb will be used. In addition, once the bulb has been safely transported and removed from disposal tube 10, the disposal tube 10 can then be used for disposal of the old bulb when it is removed or replaced. Until such time as the new bulb is used, it can remain safely in disposal tube 10 during storage, again providing a level of safety if the bulb is broken for any reason while being stored.

The disclosures of each patent, patent application and publication cited or described in this document are hereby incorporated herein by reference, in their entirety.

While the foregoing specification has been described with regard to certain preferred embodiments, and many details have been set forth for the purpose of illustration, it will be apparent to those skilled in the art without departing from the spirit and scope of the invention, that the invention may be subject to various modifications and additional embodiments, and that certain of the details described herein can be varied considerably without departing from the basic principles of the invention. Such modifications and additional embodiments are also intended to fall within the scope of the appended claims.

What is claimed is:

1. A disposal container for spent fluorescent bulbs, comprising:

a tube of 2 mil puncture resistant plastic having an open end and a sealed end, the tube being from about three inches to about three feet long;

means for sealing the open end after a spent fluorescent bulb is inserted inside the tube thereby providing a glass shard puncture resistant gas impervious container for the fluorescent bulb; and a strip of sulfur impregnated activated carbon paper located inside the tube for absorbing any gasses such as mercury released from a broken fluorescent bulb.

2. A disposal container for spent fluorescent bulbs, comprising:

a tube of 2 mil puncture resistant plastic having an open end and a sealed end, the tube being from about three inches to about three feet long;

means for sealing the open end after a spent fluorescent bulb is inserted inside the tube thereby providing a glass shard puncture resistant gas impervious container for the fluorescent bulb; and a desiccant package of sulfur-impregnated activated carbon granules located inside the tube.

3. The container of claim 1, wherein the tube is a puncture-resistant light mil plastic with a heavy paper liner.

4. The container of claim 3 wherein instead of a strip of sulfur impregnated activated carbon paper inside the tube, a strip of sulfur chalk is attached to the paper liner.

5. The container of claim 3 wherein instead of a strip of sulfur impregnated activated carbon paper inside the tube, sulfur is impregnated into the paper liner.

* * * * *